US011826006B2

(12) United States Patent
Kang et al.

(10) Patent No.: US 11,826,006 B2
(45) Date of Patent: Nov. 28, 2023

(54) CLEANER

(71) Applicant: LG ELECTRONICS INC., Seoul (KR)

(72) Inventors: Hyemin Kang, Seoul (KR); Sangik Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 597 days.

(21) Appl. No.: 16/971,249

(22) PCT Filed: Feb. 20, 2019

(86) PCT No.: PCT/KR2019/002067
§ 371 (c)(1),
(2) Date: Aug. 19, 2020

(87) PCT Pub. No.: WO2019/164261
PCT Pub. Date: Aug. 29, 2019

(65) Prior Publication Data

US 2020/0383533 A1 Dec. 10, 2020

(30) Foreign Application Priority Data

Feb. 20, 2018 (KR) ..... 10-2018-0019885

(51) Int. Cl.
*A47L 9/06* (2006.01)
*A47L 9/14* (2006.01)
*A47L 5/22* (2006.01)

(52) U.S. Cl.
CPC ..... *A47L 5/225* (2013.01); *A47L 9/0673* (2013.01); *A47L 9/1409* (2013.01); *A47L 9/14* (2013.01);
(Continued)

(58) Field of Classification Search
CPC . A47L 5/225; A47L 9/02; A47L 9/242; A47L 9/24; A47L 9/248; A47L 2201/04; A47L 9/1409; A47L 9/14; A47L 5/28
(Continued)

(56) References Cited

U.S. PATENT DOCUMENTS

2003/0217431 A1* 11/2003 Uratani ..... A47L 9/02 15/328
2004/0206238 A1* 10/2004 Allgeier ..... A47L 5/28 55/482

FOREIGN PATENT DOCUMENTS

KR 2001104041 A * 11/2001 ..... A47L 5/362
KR 10-0414255 B1 1/2004
(Continued)

*Primary Examiner* — David Redding
(74) *Attorney, Agent, or Firm* — Birch, Stewart, Kolasch & Birch, LLP

(57) ABSTRACT

A cleaner including: a main body having a first connection flow path which is formed in an outside thereof; and a nozzle having a suction port through which air is introduced: wherein the nozzle comprises: a case in which the suction port and a second connection flow path are formed, the second connection flow path which is hooked to the first connection flow path, a push button able to linearly move through one surface of the case in a predetermined pressing direction; and a detachment unit mounted in the case to be rotated about a rotating shaft positioned in a direction parallel to the pressing direction, and interlocked with the push button to release hook coupling of the first connection flow path and the second connection flow path when rotating.

13 Claims, 11 Drawing Sheets

(52) U.S. Cl.
CPC ..... *A47L 2201/00* (2013.01); *A47L 2201/04* (2013.01)

(58) Field of Classification Search
USPC ..... 285/7, 317, 921; 15/414, 415.1
See application file for complete search history.

(56) References Cited

FOREIGN PATENT DOCUMENTS

| | | | |
|---|---|---|---|
| KR | 10-0640920 | B1 | 11/2006 |
| KR | 10-2016-0088222 | A | 7/2016 |
| KR | 10-2017-0131158 | A | 11/2017 |
| KR | 10-2017-0131170 | A | 11/2017 |

* cited by examiner

CLEANER

TECHNICAL FIELD

The present invention relates to a cleaner, and more particularly to a cleaner capable of automatic cleaning and manual cleaning.

BACKGROUND ART

In general, a cleaner includes a main body having a suction device and dust box, and a nozzle connected to the main body to perform cleaning in a state close to a surface to be cleaned.

The cleaner is divided into a manual cleaner for manually cleaning the surface to be cleaned by a user and an automatic cleaner for cleaning the surface to be cleaned while the main body travels automatically.

In the manual cleaner, when the user places the nozzle on the surface to be cleaned with holding the cleaner nozzle or the main body by hand in a state in which the suction device generates a suction force by a driving force of an electric motor, the nozzle sucks a foreign substance such as dust on the surface to be cleaned by the suction force, and the suctioned foreign substance is collected in the dust box, thereby cleaning the surface to be cleaned.

In addition, in the automatic cleaner, an ultrasonic sensor and/or a camera sensor are further mounted on the main body having the suction device and the dust box, and when the main body automatically travels around the surface to be cleaned, the nozzle sucks a foreign substance on the surface to be cleaned by the suction force generated by the suction device, and the suctioned foreign substance is collected in the dust box, thereby cleaning the surface to be cleaned.

The nozzle used in the manual cleaner is moved to the surface to be cleaned by the user and is brought into close contact with the surface to be cleaned, while the nozzle used in the automatic cleaner is positioned in close contact with the surface to be cleaned when the nozzle is coupled to the main body.

And, a wheel for traveling the main body is mounted in the main body of each of the manual cleaner and the automatic cleaner, and the wheel mounted on the manual cleaner allows that the user to easily drag the main body while the main body is placed on a floor surface at the time of cleaning, and the wheel mounted on the automatic cleaner is rotated by the driving force of the electric motor and allows that the main body travels automatically.

Recently, development of the cleaner capable of both automatic cleaning and manual cleaning has become more active. However, since the nozzle used for automatic cleaning is positioned in close to the floor surface to be cleaned, there is a problem that when the user performs the manual cleaning the nozzle used for automatic cleaning becomes difficult to drag the main body due to being stuck on the threshold or the like, therefore when the user desires the manual cleaning, it is necessary for the user to detach the nozzle for the automatic cleaning from the main body and replace it with the nozzle used for manual cleaning.

In addition, the nozzle used for manual cleaning is defined to have a sufficient length so that the user can perform the cleaning while standing. However, a driving area of the cleaner must be narrowed when the length of the nozzle used for automatic cleaning is long, therefore it is necessary for the nozzle used for automatic cleaning to define as short as possible so that the entire length of the nozzle and the main body in a driving direction should be short.

There is a method for shortening the length of a connection flow path defined on the outside of each of the main body and the nozzle and connected each other, so that the entire length of the nozzle and the main body in a driving direction should be short.

However, when the length of the connection flow path in a state where the nozzle is coupled to the main body is shortened, then the connection flow path is positioned below the main body and protrudes outward from the main body. Therefore, if a detachment structure capable of detaching the nozzle used for automatic cleaning from the main body is mounted in the connection flow path, there is a problem that the user has to see the bottom of the main body to find the detachment structure and also the sealing performance of the connection flow path is deteriorated due to the detachment structure mounted on the connection flow path.

DISCLOSURE

Technical Problem

The present invention has been made in view of the above problems, and it is one object of the present invention to provide a cleaner capable of automatic cleaning and manual cleaning, and capable of easily switching from the automatic cleaning to the manual cleaning by mounting a detachment structure capable of detaching a nozzle used for automatic cleaning from a main body on the nozzle used for automatic cleaning.

It is another object of the present invention to provide a cleaner capable of optimizing a sealing of a flow path, which is a major factor in cleaning performance by mounting a detachment structure capable of detaching a nozzle used for automatic cleaning from a main body on the nozzle used for automatic cleaning.

It is yet another object of the present invention to provide a cleaner that simplifies the structure through integration of parts by configuring to seat a lower side of a dust box on a connector connecting a main body and a nozzle.

Objects of the present invention should not be limited to the aforementioned objects and other unmentioned objects will be clearly understood by those skilled in the art from the following description.

Technical Solution

In order to achieve the aforementioned aspects, a cleaner according to an embodiment of the present invention including: a main body having a first connection flow path which is formed in an outside of the main body to guide air from the outside to an inside of the main body; and a nozzle having a suction port through which air is introduced: wherein the nozzle comprises: a case in which the suction port and a second connection flow path are formed, wherein the second connection flow path guides the air introduced through the suction port to the outside and is hooked to the first connection flow path, a push button being able to linearly move through one surface of the case in a predetermined pressing direction; and a detachment unit mounted in the case to be rotated about a rotating shaft positioned in a direction parallel to the pressing direction, and interlocked with the push button to release hook coupling of the first connection flow path and the second connection flow path when rotating.

The detachment unit may include: a rotational member interlocked with the push button to be rotated about the rotating shaft, and positioned in the case; and a detachment pin hinged to the rotational member to linearly move in response to rotation of the rotational member and release the hook coupling by protruding out of the case in response to linear movement thereof.

The rotational member may include: a hinge portion hinged to the case; a first arm portion protruding from the hinge portion in one direction and contacting the push button; and a second arm portion protruding in a direction different from the direction in which the first arm portion protrudes from the hinge portion, and the detachment pin connected to an end of the second arm to protrude in a direction crossing the direction in which the second arm portion protrudes.

The second arm portion protruding in a direction crossing to the direction in which the first arm portion protrudes, and the detachment pin connected to the end of the second arm portion to protrude in a direction opposite to the direction in which the first arm portion protrudes.

A guide hole for guiding linear movement of the detachment pin in response to rotation of the rotational member is formed in the detachment pin, and a guide protrusion to be inserted into the guide hole is formed in the case.

The detachment unit may include a rotational member interlocked with the push button to rotate about the rotating shaft, and positioned in the case, the rotational member may include: a hinge portion hinged to the case; a first arm portion protruding from the hinge portion in one direction and contacting the push button; and a second arm portion protruding from the hinge portion in a direction different from the direction in which the first arm portion protrudes, and the push button presses the first arm portion, when moving in the pressing direction, to rotate the rotational member in one direction.

A first cam is formed in the push button, and a second cam slidingly interlocked with the first cam is formed in the first arm portion.

The rotating shaft is formed in the case, and a hinge hole to be hinged to the rotating shaft is formed in the rotational shaft.

A slit extending from the hinge hole is formed in the rotational member, and the nozzle further comprises an elastic member to be coupled to the rotating shaft and the slit to return the rotating member back to an original position thereof.

The second connection flow path is inserted into the first connection flow path, and the detachment pin is inserted into the first connection flow path from an outside of the second connection flow path to push a hook portion formed in the first connection flow path, thereby releasing the hook coupling of the first connection flow path and the second connection flow path.

A button guide boss protrudes from the case so that the push button is allowed to linearly move upward and downward.

The nozzle further comprises an elastic member to be inserted into the button guide boss to return the push button to an original position thereof.

A stopper for restraining rotation of the first arm portion protrudes from the case at a position where the hook coupling of the first connection flow path and the second connection flow path is released.

A separation preventing protrusion protrudes upward of the first arm portion from the stopper.

The main body protrudes outward further than the first connection flow path and the second connection flow path, and the nozzle protrudes outward further than the main body.

The cleaner may further include: a dust box detachably coupled to the main body and storing a foreign substance; and a connector connecting the main body and the nozzle, and having the dust box seated therein, wherein the first connection flow path is formed in the connector.

The case may include: an upper case in which a through hole, through which the push button passes in a vertical direction, and the second connection flow path are formed; and an lower case which is coupled to the upper case, and in which the suction port communicating with an inner space of the upper case, the push button able to linearly move upward and downward, and the detachment unit able to rotate are formed.

Advantageous Effects

The cleaner according to the present invention has the following effects.

First, since a push button is provided in one side of a nozzle and a detachment unit interlocked with the push button is provided inside of the nozzle, there is an effect that the user may detach the nozzle by intuitively looking and pushing the push button positioned in the nozzle.

Second, since a detachment unit is provided inside of a nozzle, there is an effect that a sealing of a flow path, which is a major factor in cleaning performance, may be optimized.

Third, since a lower side of a dust box is seated on a connector connecting a main body and a nozzle, there is an effect that the structure can be simplified through integration of parts.

Effects of the present invention should not be limited to the aforementioned effects and other unmentioned effects will be clearly understood by those skilled in the art from the claims.

BEST MODE

Advantages and features and a method of achieving the same will be more clearly understood from embodiments described below in detail with reference to the accompanying drawings. However, embodiments are not limited to the following embodiments and may be implemented in various different forms. The embodiments are provided merely to complete disclosure and to provide those skilled in the art with the category of the invention. The invention is defined only by the claims. Wherever possible, the same reference numbers will be used throughout the specification to refer to the same or like parts.

Hereinafter, a cleaner according to an embodiment of the present invention will be described with reference to the drawings.

Figure 1:
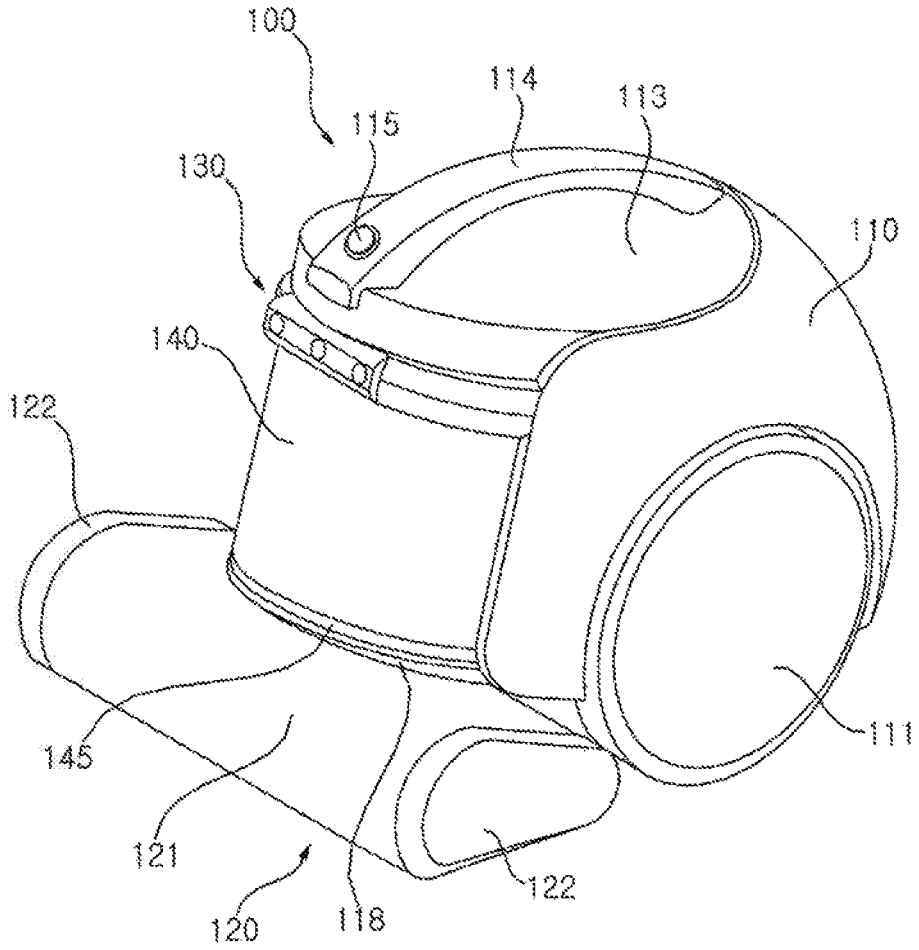
FIG. 1 is a perspective view of a cleaner according to an embodiment of the present invention.
Figure 2:
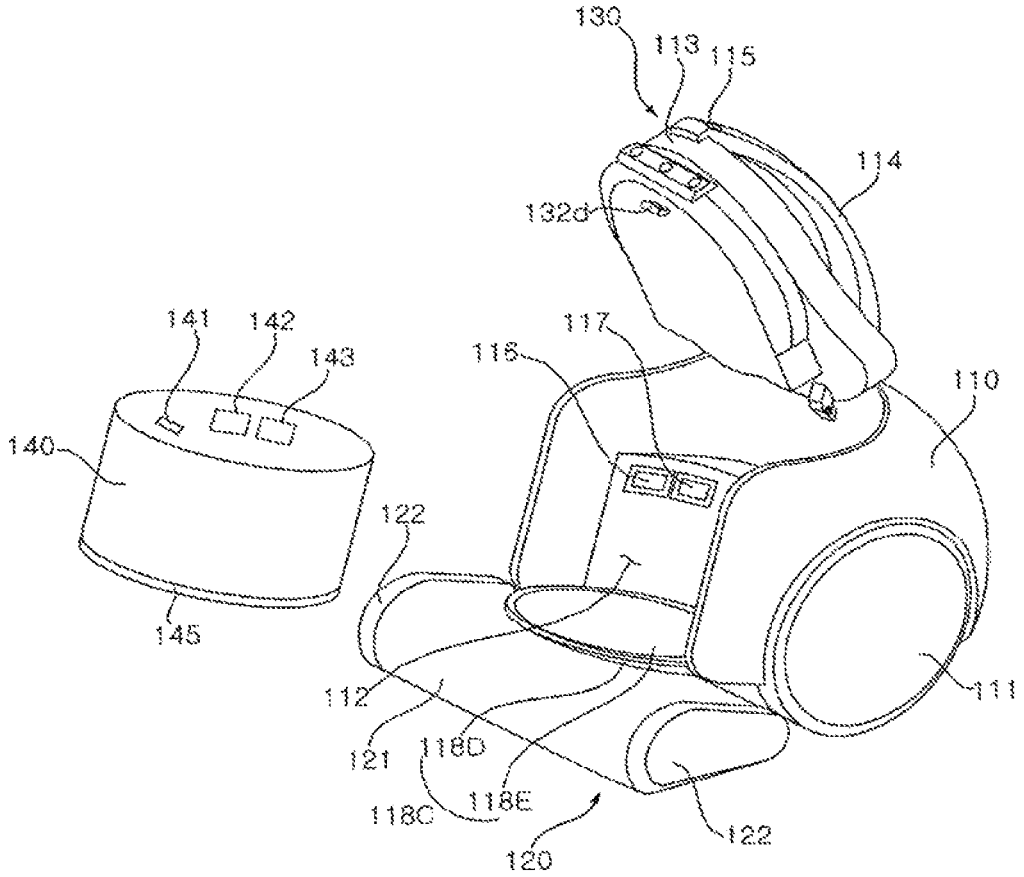
FIG. 2 illustrates the cleaner shown in FIG. 1, from which dust box is removed.

FIG. 1 is a perspective view of a cleaner according to an embodiment of the present invention. FIG. 2 illustrates the cleaner shown in FIG. 1, from which dust box is removed.

Referring to FIGS. 1 and 2, the cleaner 100 includes a main body 110, a nozzle 120, a sensing unit 130 and a dust box 140.

The main body 110 is equipped or mounted with various components including a control unit (not shown) for controlling of the cleaner 100. The main body 110 may define a space in which various components configuring the cleaner 100 are accommodated.

The main body 110 may be selected and travelled in one of an automatic mode and a manual mode by the user. The main body 110 may include a mode selection input unit for the user to select one of the automatic mode and the manual mode. When the user selects the automatic mode in the mode selection input unit, the main body 110 may automatically travel like a robot cleaner. In addition, when the user selects the manual mode in the mode selection input unit, the main body 110 may be manually driven by being dragged or pushed by the user's force.

The main body 110 includes a wheel 111 for driving. The wheel 111 is configured to be rotatable by receiving a driving force from a motor (not shown). A rotation direction of the motor can be controlled by a control unit (not shown), so that the wheel 111 may be configured to be rotatable in one direction or another direction.

The wheel 111 may be included on each of both left and right sides of the main body 110. The main body 110 may be moved or rotated in every direction by the wheel 111.

Each of the wheel 111 may be configured to be drivable independently of each other. To this end, each of the wheel 111 may be driven by a different motor.

The driving of the wheel 111 is controlled by the control unit, so that the cleaner 100 may automatically travel on a floor.

The wheel 111 is provided in a lower portion of the main body 110 to travel the main body 110. The wheel 111 may be configured as circular wheels, circular rollers connected by a belt chain, or a combination of a wheel composed of circular wheels and a wheel composed of circular rollers connected by a belt chain. The upper portion of the wheel 111 may be positioned inside of the main body 110, and the lower portion of the wheel 111 may protrude downward of the main body 110. At least bottom of the wheel 111 is brought into contact with a floor surface, which is a surface to be cleaned, so that the main body 110 may be travelled.

The wheel 111 may be mounted on both the left and right sides of the main body 110. The wheel 111 positioned on the left side of the main body 110 and the wheel 111 positioned on the right side of the main body 110 may be driven independently of each other. That is, the wheel 111 positioned on the left side of the main body 110 may be connected to each other through at least one first gear, and may be rotated by a driving force of first driving motor that rotates the first gear. In addition, the wheel 111 positioned on the right side of the main body 110 may be connected to each other through at least one second gear, and may be rotated by a driving force of second driving motor that rotates the second gear.

The control unit may determine the driving direction of the main body 110 by controlling the rotation speed of a rotating shaft of each of the first driving motor and the second driving motor. For example, when the rotating shaft of each of the first driving motor and the second driving motor is rotated at the same speed at the same time, the main body 110 may move straight forward. In addition, when the rotating shaft of each of the first driving motor and the second driving motor is rotated at different speed at the same time, the main body 110 may turn left or right. The control unit may drive one of the first driving motor and the second driving motor and stop the other so as to make the main body 110 turn left or right.

A suspension unit may be mounted inside of the main body 110. The suspension unit may include a coil spring. By use of an elastic force of the coil spring, the suspension unit may absorb shock and vibration that are transferred from the wheel 111 during traveling of the main body 110.

In addition, the suspension unit may include a lifting unit for adjusting a height of the main body 110. The lifting unit may be mounted on the suspension unit to be movable upward and downward, and may be coupled to the main body 110. Therefore, when the lifting unit is moved upward from the suspension unit, the main body 110 may be moved upward together with the lifting unit. When the lifting unit is moved downward from the suspension unit, the main body 110 may be moved downward together with the lifting unit. The main body 110 may be moved upward and downward by the lifting unit, so that a height of the main body 110 may be adjusted.

When the main body 110 travels on a hard floor using the wheel 111, the floor surface may be cleaned while a bottom surface of the nozzle 120 moves in contact with the floor surface. However, in the case where a carpet is laid on the floor surface to be cleaned, the wheel 111 may slip, and thus, driving performance of the main body 110 may be dampened and the driving performance of the main body 110 may be degraded due to a force of sucking the carpet by the nozzle 120.

However, the lifting unit may adjust the height of the main body 110 according to the slip rate of the wheel 110, so it is possible to adjust the degree of the bottom surface of the nozzle 120 being in close contact with the surface to be cleaned. Thus, the driving performance of the main body 110 may be maintained, regardless of a material of which the floor is formed.

Meanwhile, in the case where the wheel 111 positioned on the left side of the main body 110 is connected to the first driving motor through the first gear and the wheel 111 positioned on the right side of the main body 110 is connected to the second driving motor through the second gear, the left and right wheels 111 are unable to be rotated when a user tries to drive the main body 110 in the manual mode while the first driving motor and the second driving motor are stopped. Therefore, in the manual mode of the main body 110, the connection of the left and right wheels 111 and the first and second driving motors should be released. To this end, a clutch may be provided inside of the main body 110. The clutch connects the left and right wheels 111 and the first and second driving motors in the automatic mode of the main body 110, and releases the connection of the left and right wheels 111 and the first and second driving motors in the manual mode of the main body 110.

The main body 110 includes a battery (not shown) for supplying power to the electrical components of the cleaner 100. The battery may be configured to be rechargeable and may be configured to be detachably attached to the main body 110.

The main body 110 includes a dust box accommodation portion 112, and a dust box 140 for collecting dust separated from sucked air may be detachably coupled to the dust box accommodation portion 112.

The dust box accommodation portion 112 may have a shape opened frontward and upward of the main body 110, and may be recessed from the front side to the rear side of the main body 110. The dust box accommodation portion 112 may be formed with the front portion of the main body 110 being open frontward, upward, and downward.

The dust box accommodation portion 112 may be formed at a different position (e.g., at the rear side of the main body 110), depending on the type of the cleaner.

The dust box 140 is detachably coupled to the dust box accommodation portion 112. One part of the dust box 140 may be accommodated in the dust box accommodation portion 112, and the other part of the dust box 140 may protrude forward of the main body 110.

The dust box 140 includes an inlet 142 through which dust-contained air is introduced and an outlet 143 through which dust-separated air is exhausted. When the dust box 140 is mounted on the dust box accommodation portion 112, the inlet 142 and the outlet 143 are configured to respectively communicate with a first opening 116 and a second opening 117, which are formed in the inner wall of the dust box accommodation portion 112.

An air intake flow path formed inside of the main body 110 corresponds to a flow path from the nozzle 120 to the first opening 116, and an air exhaust flow path formed inside of the main body 110 corresponds to a flow path from the second opening 117 to an exhaust port.

Due to the above-described configuration, the dust-contained air introduced through the nozzle 120 is introduced to the dust box 140 through the air intake flow path inside of the main body 110, and the air and dust are separated from each other through at least one filter (e.g., a cyclone, a filter, etc.). The dust is collected in the dust box 140, and, after the air is exhausted from the dust box 140, the air passes through the air exhaust flow path inside of the main body 110 and finally exhausted to the outside through the exhaust port.

An upper cover 113 covering the dust box 140 accommodated in the dust box accommodation portion 112 is provided in the main body 110. The upper cover 113 may be hinged to one side of the main body 110 and configured to be rotatable. The upper cover 113 may cover the opened upper side of the dust box accommodation portion 112 to cover the upper side of the dust box 140. In addition, the upper cover 113 may be configure to be detachable from the main body 110.

When the upper cover 113 is positioned to cover the dust box 140, separating the dust box 140 from the dust box accommodation port 112 may be restricted.

A handle 114 is provided in an upper side of the upper cover 113. A photographing unit 115 may be provided in the handle 114. In this case, the photographing unit 115 may be positioned to be inclined against a bottom surface of the main body 110 so as to photograph both a frontward area and an upward area.

The photographing unit 115 may be provided in the main body 110 to photograph an image for SLAM (Simultaneous Localization And Mapping). The image photographed by the photographing unit 115 is used to generate a map of the driving area or to sense the current position of the cleaner 100 in the driving area.

The photographing unit 115 may generate a three-dimensional coordinate information related to the surroundings of the main body 110. That is, the photographing unit 115 may be a 3D depth camera which calculates the distance between the cleaner 100 and a target object to be photographed. Accordingly, a field data on the three-dimensional coordinate information may be generated.

Specifically, the photographing unit 115 may photograph a two-dimensional image related to the surroundings of the main body 110, and may generate a plurality of the three-dimensional coordinate information corresponding to the photographed two-dimensional image.

In one embodiment, the photographing unit 115 may include two or more cameras which acquire an existing two-dimensional image, and may be defined stereo vision system that generates the three-dimensional coordinate information by combining the two or more images acquired from the two or more cameras.

Specifically, the photographing unit 115 according to the embodiment may include a first pattern irradiating unit for irradiating light of a first pattern downward toward a front of a main body, a second pattern irradiating unit for irradiating light of a second pattern upward toward the front of the main body, and an image acquiring unit for acquiring an image of an area frontward of the main body. Therefore, the image acquiring unit may acquire an image of a region on which light of the first pattern and light of the second pattern are incident.

In another embodiment, the photographing unit 115 may include infrared ray pattern emitting unit for irradiating an infrared ray pattern together with a single camera, and, a distance between the photographing unit 115 and a target object to be photographed may be measured by capturing a shape of the infrared ray pattern irradiated on the target object. The photographing unit 115 may be an IR (Infrared) photographing unit 115.

In yet another embodiment, the photographing unit 115 may include a light emitting unit for emitting light together with a single camera, and, a distance between the photographing unit 115 and a target object to be photographed may be measured by receiving a part of a laser emitted from the light emitting unit reflected from the target object and analyzing the received laser. The photographing unit 115 may be a TOF (Time of Flight) photographing unit 115.

Specifically, the laser of the photographing unit 115 as described above is configured to irradiate a laser extending in at least one direction. In one embodiment, the photographing unit 115 may include first and second lasers, wherein the first laser may irradiate a linear laser intersecting each other and the second laser may irradiate a single linear laser. In this case, a lowermost laser is used to sense an obstacle in a bottom area, a uppermost laser is used to sense an obstacle in an upper height area, and an intermediate laser between the lowermost laser and the uppermost laser is used to sense an obstacle in an intermediate height area.

The sensing unit 130 may be positioned below the upper cover 113, and the sensing unit 130 may be detachably coupled to the dust box 140.

The sensing unit 130 is provided in the main body 110 to sense information related to the environment where the main body 110 is located. The sensing unit 130 senses information related to the environment to generate field data.

The sensing unit 130 senses nearby features (including an obstacle) to prevent the cleaner 100 from colliding the obstacle. The sensing unit 130 may sense information about the outside of the cleaner 100. The sensing unit 130 may sense a user around the cleaner 100. The sensing unit 130 may sense an object around the cleaner 100.

In addition, the sensing unit 130 is capable of panning (movement of right and left) and tilting (inclined up and down) to improve the sensing function and the driving function of the cleaner.

The sensing unit 130 is positioned at the front of the main body 110 and positioned between the dust box 140 and the upper cover 113. A coupling protrusion 132*d* protrudes from the lower side of the sensing unit 130, and a coupling groove 141, into which the coupling protrusion 132*d* is inserted to be coupled, is formed in the upper side of the dust box 140. When the upper cover 113 covers the upper side of the dust box accommodation portion 112, the dust box 140 is coupled to the sensing unit 130 due to the insertion of the coupling protrusion 132*d* into the coupling groove 141, and thus, the dust box 140 is not allowed to be detached from the main body 110. On the other hand, when the upper cover 113 opens on the upper side of the dust box accommodation portion 112, the dust box 140 is uncoupled from the sensing unit 130 due to the release of the coupling protrusion 132*d* from the coupling groove 141, and thus, the dust box 140 is allowed to be detached from the main body 110.

The sensing unit 130 may include at least one of an external signal sensor, an obstacle sensor, a cliff sensor, a lower camera sensor, an upper camera sensor, an encoder, an impact sensor, and a microphone.

The external signal sensor may sense an external signal of the cleaner 100. The external signal sensor may be, for example, an infrared ray sensor, an ultrasonic sensor, a radio frequency sensor, or the like. In this case, field data on the external signal may be generated.

The cleaner 100 may receive information on a position and a direction of a charging base by receiving a guide signal, generated from the charging base, using the external signal sensor. In this case, the charging base may transmit the guide signal indicating the direction and the distance so that the cleaner 100 can return. That is, the cleaner 100 may receive a signal transmitted from the charging base, determine the current position of the cleaner 100, set a moving direction, and return to the charging base.

The obstacle sensor may sense an obstacle located in a front area. In this case, field data on the obstacle is generated.

The obstacle sensor may sense an object existing in a moving direction of the cleaner 100 and transmit the generated field data to the control unit. That is, the obstacle sensor may sense protrusions, fixture, furniture, walls, wall corners, or the like existing on a moving path of the cleaner 100, and transmit field data on the sensed obstacles to the control unit.

The obstacle sensor may be, for example, an infrared sensor, an ultrasonic sensor, a radio frequency sensor, a geomagnetic sensor, or the like. The cleaner 100 may use one type of sensor as the obstacle sensor, or, if necessary, two or more types of sensors.

The cliff sensor may sense an obstacle on the floor, which supports the main body 110, usually using various types of optical sensors. In this case, field data on the obstacle on the floor is generated.

The cliff sensor may be an infrared sensor, an ultrasonic sensor, a radio frequency sensor, or a PSD (position sensitive detector) sensor, which includes a light emitting unit and a light receiving unit as does the obstacle detecting sensor.

For example, the cliff sensor may be a PSD sensor, but it may be configured as a plurality of different kinds of sensors. The PSD sensor includes a light emitting unit for emitting infrared rays to an obstacle, and a light receiving unit for receiving infrared rays reflected from the obstacle. The PSD sensor may be generally in the form of a module. When the obstacle is sensed using the PSD sensor, a stable measurement value may be obtained regardless of reflectivity and color of the obstacle.

The control unit may sense a cliff by measuring an infrared ray angle between a light emission signal of an infrared ray emitted from the cliff sensor toward the ground and a reflection signal received by being reflected from the obstacle, and may acquire filed data on a depth of the cliff.

The lower camera sensor acquires image information (field data) on a surface to be cleaned while the cleaner 100 is traveling. The lower camera sensor may be also referred to as an optical flow sensor. The lower camera sensor may convert an image of a lower side input from an image sensor in the sensor to generate image data (field data) of a predetermined format. Field data on the image recognized through the lower camera sensor may be generated.

Using the lower camera sensor, the control unit may sense a position of the cleaner regardless of the slipping of the cleaner. The control unit may compare and analyze the image data photographed by the lower camera sensor according to the flow of time to calculate a moving distance and a moving direction, and calculate the position of the cleaner on the basis of the moving distance and the moving direction.

The upper camera sensor may be mounted to face the upward or forward direction of the cleaner 100 to photograph around the cleaner 100. When the cleaner 100 includes a plurality of upper camera sensors, the camera sensors may be formed at an upper portion or on a lateral surface of the cleaner at a predetermined distance or predetermined angle. Field data on the image recognized through the upper camera sensor may be generated.

The encoder may sense information related to an operation of the motor that drives the wheel 111. In this case, field data on the operation of the motor is generated.

The impact sensor may sense an impact when the cleaner 100 collides with an external obstacle or the like. In this case, field data on the external impact is generated.

The microphone may sense an external sound. In this case, field data on the external sound is generated.

In this embodiment, the sensing unit 130 includes an image sensor. In this embodiment, the field data is image information acquired by the image sensor, or feature information extracted from the image information, but the present invention is not necessarily limited thereto.

Meanwhile, a connector 118 may be provided on an open lower side of the dust box accommodation portion 112. The connector 118 may be coupled to the main body 110 to configure part of the main body 110. That is, when coupled to the main body 110, the connector 118 may be interpreted as the same configuration as the main body 110. On the connector 118, the dust box 140 for storing foreign substances may be seated. The connector 118 may connect the main body 110 and the nozzle 120. The connector 118 may connect the air intake flow path of the main body 110 and the air intake flow path of the nozzle 120.

The nozzle 120 is provided to suck the dust-contained air or to wipe the floor. The nozzle 120 for sucking dust-contained air may be referred to as a suction module, and the nozzle 120 for wiping the floor may be referred to as a mop module.

The nozzle 120 may be detachably coupled to the main body 110. When the suction module is detached from the main body 110, the mop module may be detachably coupled to the main body 110 in place of the separate suction module. Therefore, when the user desires to remove dusts on the floor, the user may mount the suction module on the main body 110, and when the user desires to wipe the floor, the user may mount the mop module on the main body 110.

The nozzle 120 may be provided with a function of wiping the floor after sucking dust-contained air.

The nozzle 120 may be provided below the main body 110 or may protrude from one side of the main body 110 as shown in figures. The aforementioned one side of the main body 110 may be a side which is positioned in a forward moving direction of the main body 110, that is, a front side of the main body 110. The nozzle 120 is positioned forward of the wheel 111, and part of the nozzle 120 may protrude forward further than the dust box 140.

In this drawing, the nozzles 120 protrudes from one side of the main body 110 toward the front side and the left and right sides of the cleaner. Specifically, the front end of the nozzle 120 is spaced apart from the one side of the main body 110 in a forward direction. The left and right end portions of the nozzle are spaced apart from left and right sides of the main body 110, respectively.

A suction motor may be mounted inside of the main body 110. An impeller (not shown) may be coupled to a rotating shaft of the suction motor. When the suction motor is driven and the impeller is rotated together with the rotating shaft, the impeller may generate a suction force.

The air intake flow path may be formed inside of the main body 110. Foreign substance such as dust from the surface to be cleaned may be introduced into the nozzle 120 by the suction force generated by a driving force of the suction motor and the foreign substance introduced into the nozzle 120 may be introduced into the air intake flow path.

When the main body 110 travels in an automatic mode, the nozzle 120 may clean a floor surface to be cleaned. The nozzle 120 may be positioned adjacent to a bottom surface of the front surface of the main body 110. A suction port for suctioning air may be formed on a bottom surface of the nozzle 120. When the nozzle 120 is coupled to the main body 110, the suction port may be positioned to face the floor surface.

The nozzle 120 may be coupled to the cleaner body 110 through the connector 118. The nozzle 120 may communicate with the air intake flow path of the main body 110 through the connector 118. The nozzle 120 may be positioned below the dust box 140 that is positioned on the front surface of the main body 110.

The nozzle 120 may include a case having a suction port formed in a bottom surface thereof, and a brush unit may be rotatably provided in the case. The case may have an empty space to allow the brush unit to be rotated in the space. The brush unit may include: a rotating shaft elongated in the left and right direction; and a brush protruding from the outer circumference of the rotating shaft. The rotating shaft of the brush unit may be rotatably coupled to the left and right sides of the case.

The cases 121 and 122 of the nozzle 120 may include: a center case 121; and side cases 122 positioned on the both sides of the center case 121 to define the left and right sides of the cases 121 and 122 of the nozzle 120, respectively. A suction port may be formed in a bottom surface of the center case 121. The both sides of the center case 121 may be opened, and the side cases 122 may be coupled to the both sides of the center case 121 to shield the opened sides of the center case 121.

A lower portion of the brush unit protrudes downward through the suction port formed in the bottom surface of the case, so, when the suction motor is driven, the brush unit may be rotated by the suction force to sweep up foreign substance, such as dust, from the floor surface to be cleaned. Then, the foreign substance may be introduced into the case by the suction force. The brush may be made of a material that does not cause triboelectricity to occur, so that the foreign substance is prevented from sticking to the brush easily.

The connector 118 may be coupled to the front surface of the main body 110. The connector 118 may connect the main body 110 and the nozzle 120. The nozzle 120 may be detachably coupled to the connector 118. The connector 118 may support the underside of the dust box 140.

The dust box 140 may be detachably coupled to the front surface of the main body 110 and the lower side thereof may be supported by the connector 118. The dust box 140 may include a hollow cylindrical case. A filter unit for separating foreign substance and air from the air sucked through the air intake flow path of the cleaner body 110 may be positioned in an interior of the cylindrical case. The filter unit may include a plurality of cyclones. The foreign substance such as dust caught by the filter unit may be dropped and accommodated in the dust box 140. Only the air may be exhausted to the outside of the dust box 140 and then move toward the suction motor by the suction force of the suction motor and then exhausted to the outside of the main body 110.

The lower side of the dust box 140 may be opened, and the lower side of the opened dust box 140 may be shielded by a cover 145. One side of the cover 145 may be rotatably coupled to the dust box 140 to be opened and closed. When the cover 140 is opened, an opened lower side of the dust box 140 may be opened, and then the foreign substances accommodated in the dust box 140 may fall through the opened lower side of the dust box 140. The user may separate the dust box 140 from the main body 110 and then open the cover to discard the foreign substance accommodated in the dust box 140. When the dust box 140 is coupled to the main body 110, the dust box 140 is seated on the connector 118. That is, the cover of the dust box 140 is seated on an upper side of the connector 118.

As described above, the nozzle 120 may be provided in close contact with a floor surface to be cleaned, so that the floor surface may be automatically cleaned when the main body 110 travels in the automatic mode. However, when the user desires to manually perform the cleaning, the user inputs the manual mode driving of the main body 110 through a mode selection input unit positioned in the main body 110, and then detaches the nozzle 120 from the main body 110 and then couples the manual nozzle to the main body 110 to perform manual cleaning. The manual nozzle may include a bellows-shaped long hose. In this case, a portion around the hose of the manual nozzle may be connected to the cleaner body 110.

When the user desires to switch the cleaner 100 to the manual mode from the automatic mode, it is necessary to quickly and easily detach the nozzle 120 from the connector 118. Hereinafter, a structure which enables quickly and easily detaching the nozzle 120 from the connector 118 will be described.

Figure 3:
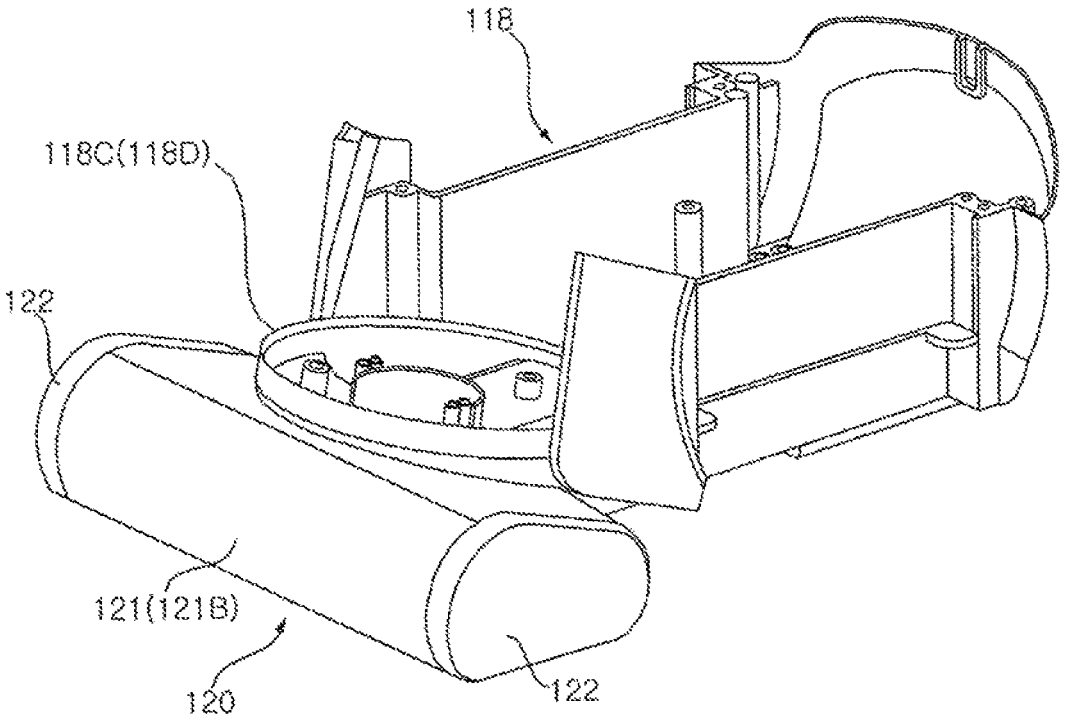
FIG. 3 is a perspective view showing coupling between a nozzle and a connector shown in FIGS. 1 and 2.
Figure 4:
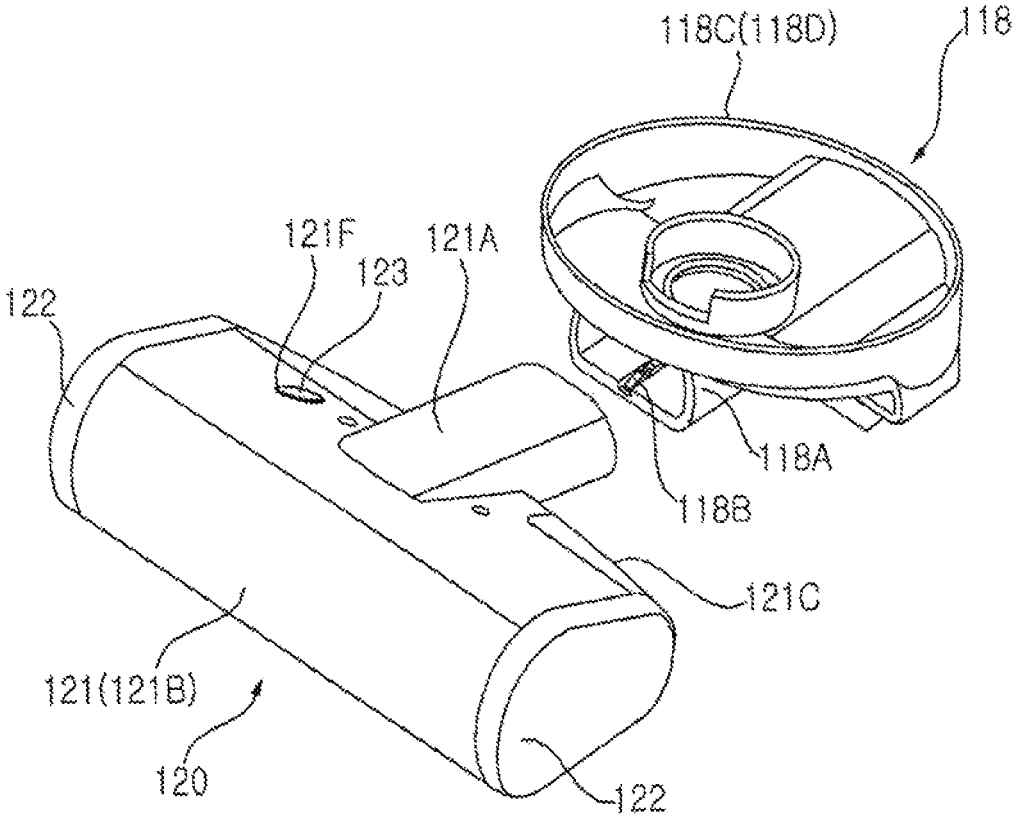
FIG. 4 is an exploded perspective view of the nozzle and the connector shown in FIGS. 1 and 2.
Figure 5:
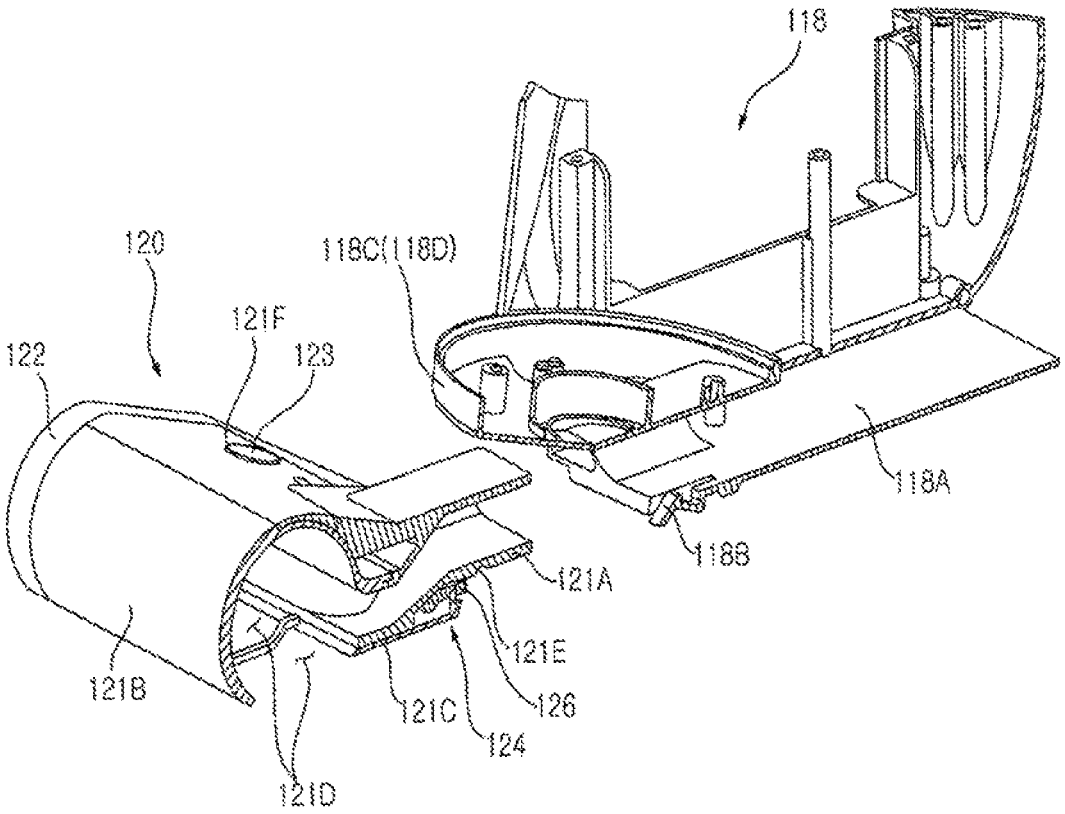
FIG. 5 is a cutaway perspective view in which a central portion of the nozzle and the connector shown in FIG. 4 is cut back and forth.
Figure 6:
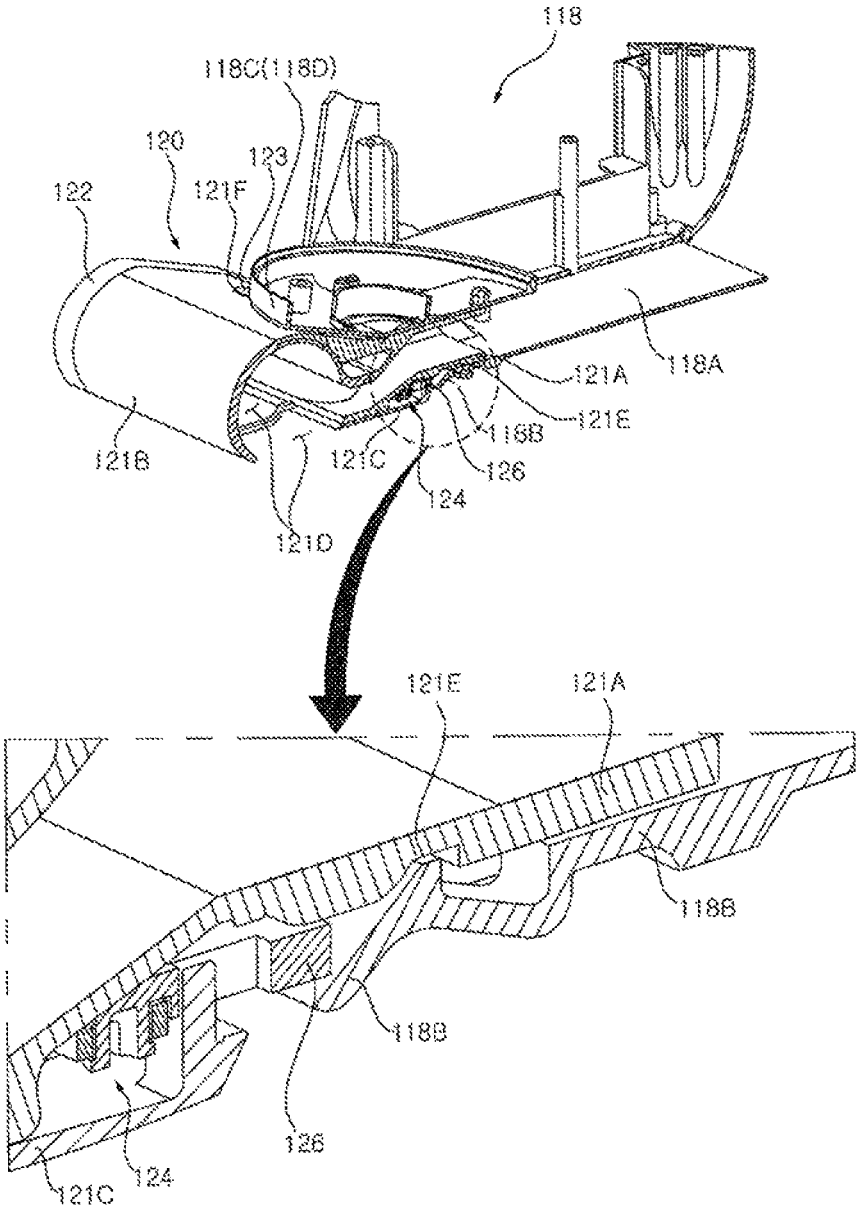
FIG. 6 illustrates the case where a nozzle is hook coupled to a connector in the same state of FIG. 5.
Figure 7:
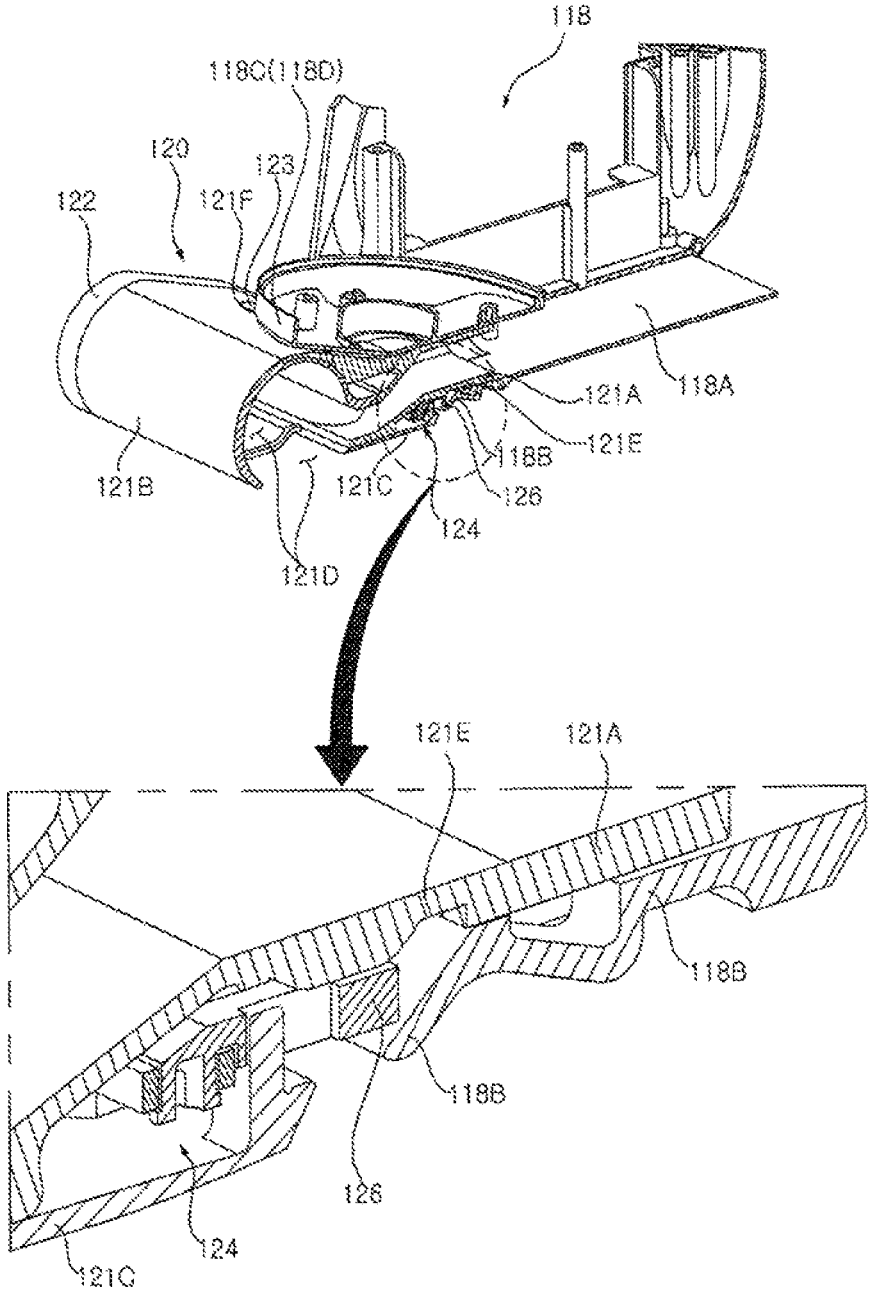
FIG. 7 illustrates the case where hook coupling of the nozzle and the connector is released in a state as the same as shown in FIG. 6.

FIG. 3 is a perspective view showing coupling between a nozzle and a connector shown in FIGS. 1 and 2. FIG. 4 is an exploded perspective view of the nozzle and the connector shown in FIGS. 1 and 2. FIG. 5 is a cutaway perspective view in which a central portion of the nozzle and the connector shown in FIG. 4 is cut back and forth. FIG. 6 illustrates the case where a nozzle is hook coupled to a connector in the same state of FIG. 5. FIG. 7 illustrates the case where hook coupling of the nozzle and the connector is released in a state as the same as shown in FIG. 6.

Referring to FIGS. 1 to 7, a first connection flow path 118A is formed in the connector 118. In FIGS. 3 to 7, the first connection flow path 118A is formed in the connector 118. However, since the connector 118 may be coupled to the main body 110 to configure part of the main body 110, so the first connection flow path 118A may be interpreted to be formed in the main body 110. The first connection flow path 118A may be formed in an outer side of the main body 110. Hereinafter, for convenience of explanation, the first connection flow path 118A is described as being formed in the connector 118.

And, the nozzle 120 may include a second connection flow path 121A protruding rearward. The second connection flow path 121A may be connected to the first connection flow path 118A. The first connection flow path 118A formed in the connector 118 of the cases 121 and 122 may connect the second connection flow path 121A of the nozzle 120 to the air intake flow path of the main body 110.

The nozzle 120 includes cases 121 and 122 having the suction port formed in the bottom surface thereof, and the second connection flow path 121A protruding from the rear side of the case 121. A rotatable brush unit may be provided in the cases 121 and 122. The empty space in the cases 121 and 122 may communicate with the second connection flow path 121A. The second connection flow path 121A protrudes rearward from the center of the left-right direction, which is a longitudinal direction, at the rear side of the cases 121 and 122. The second connection flow path 121A may protrude rearward from the center case 121.

The center case 121 may include an upper case 121B and a lower case 121C. The upper case 121B and the lower case 121C may be coupled to each other. The upper case 121B may be positioned on the upper side of the lower case 121C, and the lower case 121C may be positioned on the upper side of the upper case 121B. The side case 122 may be integrally formed with the lower case 121C.

The second connection flow path 121A may protrude rearward of the upper case 121B. The front part of the upper case 121B may be formed to have a cross section in the shape of part of a circle, and the lower side thereof may be opened. The lower case 121C may have a suction port 121D at a portion corresponding to the opened lower side of the upper case 121B. The suction port 121D may be formed in a portion of the lower case 121C corresponding the opened lower side of the upper case 121B. The suction port 121D may communicate with an inner space of the upper case 121B. The brush unit is rotatably provided in a front portion of the upper case 121B, which has a cross section in the shape of part of a circle. A part of the brush of the brush unit may protrude toward the lower side of the nozzle 120 through the suction port 121D, and sweep up foreign substance from the surface to be cleaned when rotating.

The first connection flow path 118A guides air from the outside of the main body 110 to the inside of the main body 110. In addition, the second connection flow path 121A guides the air introduced into the cases 121 and 122 through the suction port 121D of the cases 121 and 122 to the outside of the cases 121 and 122. Therefore, when the first connection flow path 118A and the second connection flow path 121A are connected to each other, the air introduced into the nozzle 120 through the suction port 121D of the nozzle 120 may move to the inside of the main body 110.

The second connection flow path 121A may be formed in a hollow cylindrical shape. The second connection flow path 121A is not necessarily formed in a cylindrical shape. For example, the second connection flow path 121A may be formed in a tapered cylindrical shape which has flat upper and lower surfaces flat and convex side surfaces. As the second connection flow path 121A communicates with the empty internal space of the cases 121 and 122, the second connection flow path 121A may allow the air and foreign substances introduced into the cases 121 and 122 to be exhausted to the outside. That is, air and foreign substances introduced into the cases 121 and 122 through the suction port 121D formed in the cases 121 and 122 may be exhausted to the outside of the nozzle 120 through the second connection flow path 121A.

The first connection flow path 118A is formed in the front portion of the connectors 118. The first connection flow path 118A is connected to the second connection flow path 121A. The first connection flow path 118A may be formed in a shape corresponding to the second connection flow path 121A so as to be connected to the second connection flow path 121A. The first connection flow path 118A may connect the second connection flow path 121A of the nozzle 120 to the air intake flow path in the main body 110. That is, one end or the front end of the first connection flow path 118A may be connected to the second connection flow path 121A, and the other end or the rear end of the first connection flow path 118A may be connected to the air intake flow path in the main body 110.

The second connection flow path 121A may be inserted into the first connection flow path 118A and connected to the second connection flow path 121A. A hook portion 118B protrudes in the first connection flow path 118A. The hook portion 118B protrudes from a bottom surface of the first connection flow path 118A, and is formed by cutting the front end of a bottom surface at the entrance of the first connection flow path 118A. A recessed hooking groove 121E is formed on an outer surface of the second connection flow path 121A. When the second connection flow path 121A is inserted into the first connection flow path 118A, the hook portion 118B is pushed to stretch in the radially outward direction of the first connection flow path 118A by the second connection flow path 121A. Then, when the hooking groove 121E is positioned above the hook portion 118B, the hook portion 118B contracts inward of the first connecting flow path 118A by the self-elastic force to be inserted into the hooking groove 121E and hooked to the second connecting flow path 121A. In this embodiment, since the second connection flow path 121A is inserted into the first connection flow path 118A, the hook portion 118B protrudes from an inner surface of the first connection flow path 118A, and the hooking groove 121E is formed in an outer surface of the second connection flow path 121A. However, when the first connection flow path 118A is inserted into the second connection flow path 121A, the hook portion 118B may protrude from an inner surface of the second connection flow path 121A, and the hooking groove 121E may be formed in an outer surface of the first connection flow path 118A.

In order to easily form the hook portion 118B in the first connection flow path 118A, the first connection flow path 118A may be formed of two pieces. That is, the first connection flow path 118A may include a lower portion and an upper portion coupled to an upper side of the lower portion, and the hook portion 118B may be formed on the upper side of the lower portion.

A push button 123 is positioned on the cases 121 and 122 of the nozzle 120. The push button 123 is positioned to be linearly movable in a predetermined pressing direction through one surface of the cases 121 and 122. In this embodiment, the push button 123 is positioned to be linearly movable upward and downward through an upper surface of the cases 121 and 122. But the push button 123 may be positioned to be linearly movable in the left and right direction through a side surface of the cases 121 and 122. Hereinafter, the push button 123 will be described as being positioned so as to be linearly movable upward and downward through the upper surface of the cases 121 and 122. In this case, downward movement direction of the push button 123 may be the same as the pressing direction of the push button 123, and the upward movement direction of the push button 123 may be the same as a reverse direction of the pressing direction of the push button 123.

A through hole 121F through which the push button 123 passes in a vertical direction may be formed in the upper case 121B. When not pushed, the push button 123 is in the form of not protruding from the upper surfaces of the cases 121 and 122 of the nozzle 120, so that the push button 123 is prevented from being pressed by a nearby obstacle during driving of the cleaner 100. That is, an upper surface of the push button 123 and the upper surfaces of the cases 121 and 122 of the nozzle 120 may be positioned at the same height when the push button 123 is not pushed. When the user pushes the push button 123, the nozzle 120 may be detached from the connector 118. Thus, the push button 123 is be positioned on the upper surface of the nozzle 120, which is a position where the user can intuitively see the cleaning button 120, so the user is able to more easily detach the nozzle 120 from the connector 118.

In order to allow the nozzle 120 to be detached from the connector 118 when the push button 123 is pushed by the user, a detachment unit 124 is mounted inside of the cases 121 and 122 of the nozzle 120. The detachment unit 124 is mounted in the cases 121 and 122 to be rotated about a rotating shaft 121G disposed in a direction parallel to the pressing direction of the push button 123, and thus, the detachment unit 124 may be rotated when the push button 123 is pushed by the user. In this embodiment, since the push button 123 is able to linearly move by being pushed in a vertical direction through the upper space of the cases 121 and 122, the detachment unit 124 is mounted in the cases 121 and 122 to be rotated about the rotating shaft 121G disposed in the vertical direction. However, when the push button 123 is able to linearly move by being pushed in a horizontal direction through a side surface of the cases 121 and 122, the detachment unit 124 may be mounted in the cases 121 and 122 to be rotated about the rotating shaft 121G disposed in the horizontal direction.

The detachment unit 124 may be rotated about the rotating shaft 121G to release the hook coupling of the first connection flow path 118A and the second connection flow path 121A. The detachment unit 124 may be interlocked with the push button 123 to push the hook portion 118B, thereby releasing the hook coupling of the first connection flow path 118A and the second connection flow path 121A by.

Meanwhile, the connector 118 supports the lower side of the dust box 140. The connector 118 includes a dust box seating portion 118C on which the dust box 140 is seated. The dust box seating portion 118C is positioned on an upper side of the first connection flow path 118A. And the first connection flow path 118A is positioned on a lower side of the dust box seating portion 118C, and does not protrude further than the dust box seating portion 118C. In addition, as shown FIGS. 1 and 2, when the nozzle 120 is coupled to the connectors 118, the dust box 140 protrudes outward from the main body 110 further than the first connection flow path 118A and the second connection path 121A, and the nozzle 120 protrudes outward from the main body 110 further than the dust box 140. This may be interpreted as follows. That is, when the nozzle 120 is coupled to the main body 110, the main body 110 protrudes outward further than the first connection flow path 118A and the second connection flow path 121A, the nozzle 120 protrudes outward further than the main body 110.

Thus, when the nozzle 120 is coupled to the connectors 118, the dust box 140 protrudes outward from the main body 110 further than the first connection flow path 118A and the second connection flow path 121A. Therefore, when the push button 123 and the detachment unit 124 are provided in the nozzle 120 protruding outward from the main body 110 further than the dust box 140, the user may easily detach the nozzle 120 from the connector 118 than when the push button 123 and the detachment unit 124 are provided in the first connection flow path 118A and the second connection flow path 121A.

As viewed above, the dust box seating portion 118C has a circular shape identical to a shape of the cover 145 to allow the cover 145 of the dust box 140 to be seated thereon. The dust box seating portion 118C may include a circular base 118D, and a base cover 118E coupled to an upper side of the base 118D. The cover 145 is substantially in contact with the top of the base cover 118E. The base cover 118E may be made of ductile a rubber or plastic material which has an elastic force, compared with the base 118D.

Figure 8:
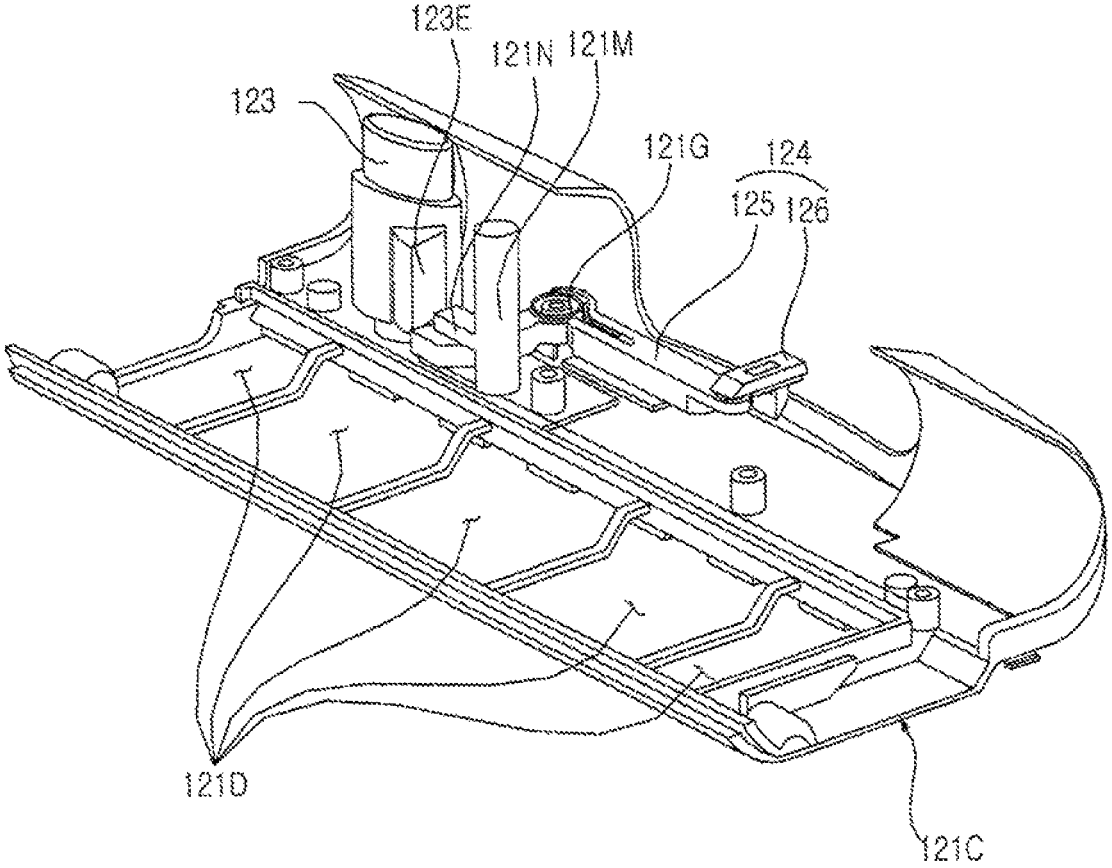
FIG. 8 is a detailed view of a detachment unit shown in FIGS. 5 to 7.
Figure 9:
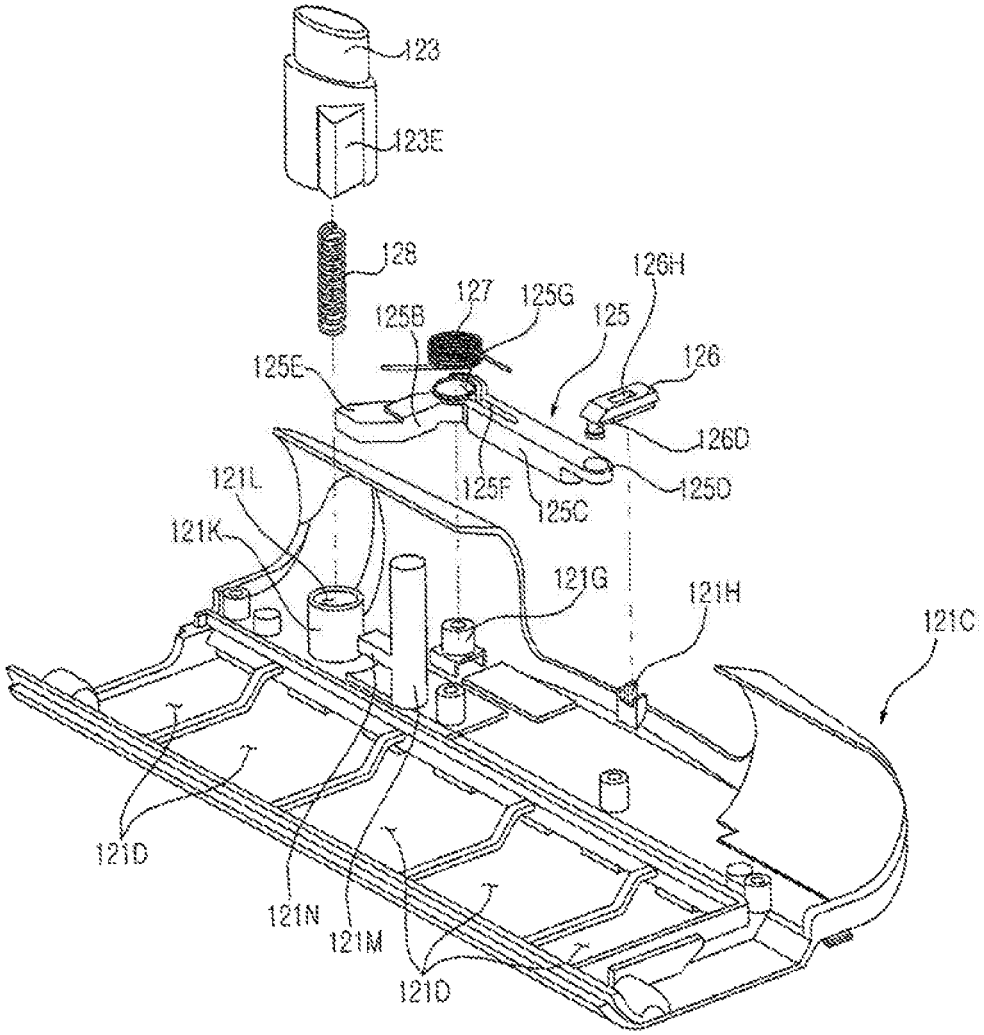
FIG. 9 is an exploded perspective view of FIG. 8.
Figure 10:
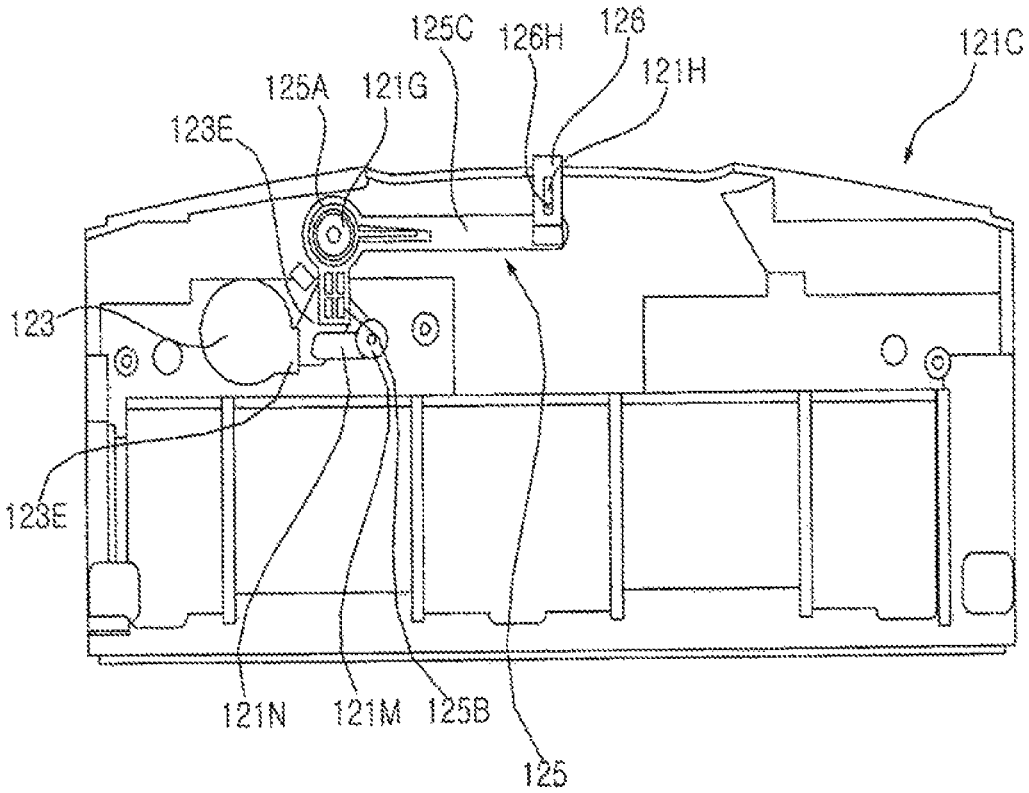
FIG. 10 is a plan view of FIG. 8.
Figure 11:
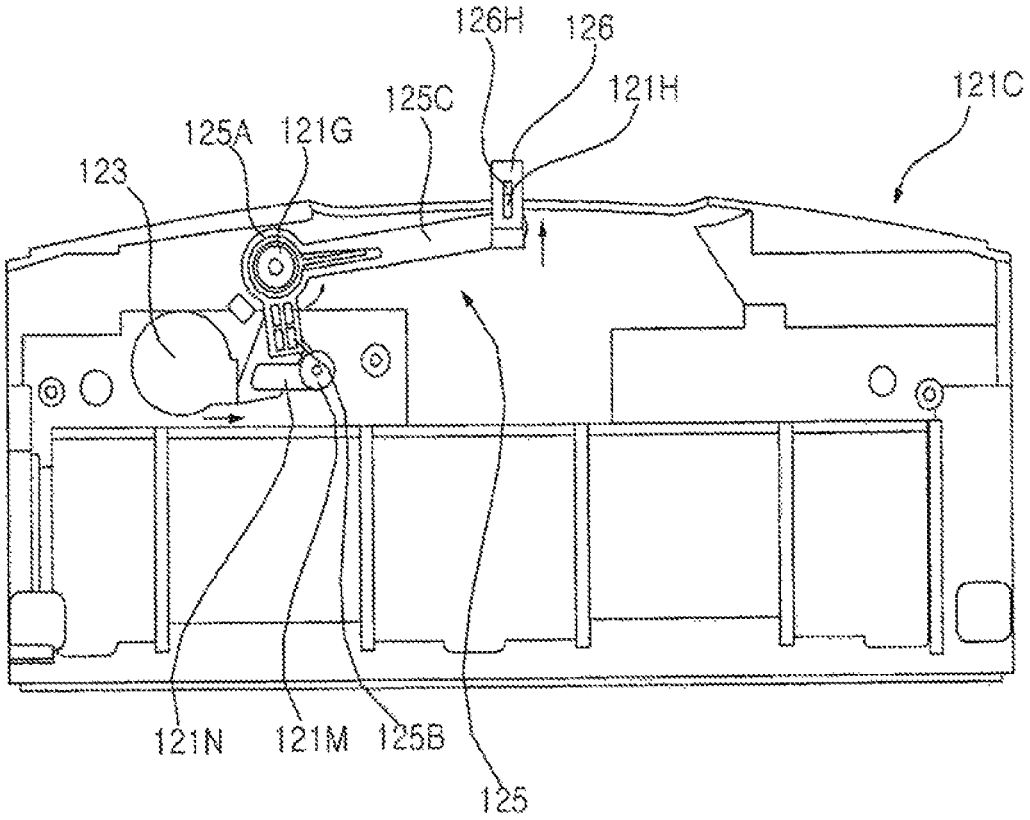
FIG. 11 is an operational view of FIG. 8.

FIG. 8 is a detailed view of a detachment unit shown in FIGS. 5 to 7. FIG. 9 is an exploded perspective view of FIG. 8. FIG. 10 is a plan view of FIG. 8. FIG. 11 is an operational view of FIG. 8.

Referring to FIGS. 1 to 11, the detachment unit 124 may be mounted in the lower case 121C of the nozzle 120. The detachment unit 124 may be positioned behind the suction port 121D of the lower case 121C. In addition, the push button 123 may be mounted in the lower case 121C to be movable upward and downward. An upper end of the push button 123, which is a portion passing through the through hole 121F formed in the upper case 121B, may be smaller in diameter than a lower end thereof. The lower end having a larger diameter is formed to have a diameter greater than the diameter of the through hole 121F. As a result, when the push button 123 tries to come out of the upper side of the cases 121 and 122 through the through hole 121F, the lower end may restrain the upward movement of the push button 123.

The detachment unit 124 may include a rotational member 125 and a detachment pin 126. The rotational member 125 may be interlocked with the push button 123 to be rotated about the rotating shaft 121G, and may be positioned in the cases 121 and 122. The detachment pin 126 may be hinged to one end of the rotational member 125, and linearly move when the rotational member 125 rotates. When the detachment pin 126 linearly moves, the detachment pin 126 may protrude out of the cases 121 and 122 from the inside of the cases 121 and 122 to thereby release the hook coupling of the first connection flow path 118A and the second connection flow path 121A. When the rotational member 125 rotates, the detachment pin 126 may linearly move to push the hook portion 118B, thereby releasing the hook coupling of the first connection flow path 118A and the second connection flow path 121A.

The rotational member 125 may be hinged to the lower case 121C. When one end of the rotational member 125 is pushed by the push button 123, the rotational member 125 may be rotated about the hinged portion of the lower case 121C. The detachment pin 126 may be hinged to the other end of the rotational member 125.

For the detachment pin 126 to be hinged to the other end of the rotational member 125, a hinge shaft 126D protrudes from a lower side of the detachment pin 126, and a hinge hole 125D, into which the hinge shaft 126D is inserted to be rotatably coupled thereto, is formed at the other end of the rotational member 125. However, the positions of the hinge shaft 126D and the hinge hole 125D may be changed with each other. That is, the hinge hole 125D may be formed in the detachment pin 126, and the hinge shaft 126D may be formed at the other end of the rotational member 125.

The rotational member 125 may include: a hinge portion 125A hinged to the cases 121 and 122 of the nozzle 120; a first arm portion 125B protruding toward one side of the hinge portion 125A and contacting the push button 123; and a second arm portion 125C protruding in a direction different from a direction in which the first arm portion 125B protrudes from the hinge portion 125A. The second arm portion 125C may protrude in a direction transverse to the direction in which the first arm portion 125B protrude from the hinge portion 125A. In this embodiment, the second arm portion 125C protrudes in a direction perpendicular to the direction in which the first arm portion 125B protrudes from the hinge portion 125A.

When the push button 123 is pressed by the user and moved in the pressing direction, the push button 123 may press the first arm portion 125B, thereby rotating the rotational member 125 in one direction. In addition, when the user releases the pushing force for pressing the push button 123, the push button 123 is moved in the opposite direction of the pressing direction, thereby rotating the rotational member 125 in the other direction.

The detachment pin 126 may be connected to an end of the second arm portion 125C in a manner in which the detachment pin 126 protrude in a direction crossing a direction in which the second arm portion 125 protrudes. In this embodiment, the detachment pin 126 is connected to the end of the second arm portion 125C in a manner in which the detachment pin 126 protrudes in a direction opposite to the direction in which the first arm portion 125B protrudes. In this embodiment, the first arm portion 125B extends in the forward direction, the second arm portion 125C extends in the left and right direction, and the detachment pin 126 extends in the rearward direction.

A first cam 123E protruding toward the first arm portion 125B is formed in the push button 123. The first cam 123E is positioned below an outer circumferential surface of the push button 123. In addition, a second cam 125E, which contacts the first cam 123E to be slidingly interlocked with the first cam 123E, protrudes from the first arm portion 125B. The second cam 125E protrudes from the first arm portion 125B toward the push button 123. When the push button 123 is pressed, the first arm portion 125B may be rotated about the hinge portion 125A by the first cam 123E pushing the second cam 125E. At the same time, the second arm portion 125C may be also rotated about the hinge portion 125A in the same direction as the first arm portion 125B.

A guide hole 126H for guiding the linear movement of the detachment pin 126 may be formed in the detachment pin 126 when the rotational member 125 rotates. In addition, a guide protrusion 121H to be inserted into the guide hole 126H may be formed in the lower case 121C. Due to the above structure, when the rotational member 125 is rotated as the push button 123 is pressed, the detachment pin 126 may linearly move rearward, rather than being rotated, and push the hook portion 118B provided in the first connection flow path 118A, thereby releasing the hook coupling of the first connection flow path 118A and the second connection flow path 121A.

Meanwhile, the rotating shaft 121G of the detachment unit 124 protrudes upward from the lower case 121C, and a hinge hole 125G, to which the rotating shaft 121G is to be hinged, is formed in the rotational member 125. However, the positions of the rotating shaft 121G and the hinge hole 125G may be changed with each other. That is, the rotating shaft 121G may protrude downward from the underside of the rotational member 125, and the hinge hole 125G may be formed in the lower case 121C. The rotating shaft 121G of the detachment unit 124 is disposed in a vertical direction, as does the linear moving direction of the push button 123, so as to allow the detachment unit 124 to be rotated on the horizontal plane of the left and right direction.

The cases 121 and 122 of nozzle 120 may be configured of at least two pieces, so that the push button 123 and the detachment unit 124 are mounted thereon. That is, the cases 121 and 122 may include the lower case 121C formed the suction port 121D and the upper case 121B coupled to the upper side of the lower case 121C. The push button 123 may be mounted in the lower case 121C to be movable upward and downward, and the detachment unit 124 may be rotatably mounted in the lower case 121C, and then the upper case 121B and the lower case 121C may be coupled with each other. The through hole 121F through which the push button 123 passes to vertically move may be formed in the upper case 121B. Since the brush unit is rotatably provided in the cases 121 or 122 at a position corresponding to the suction port 121D, the detachment unit 124 may be mounted in the lower case 121C at a position behind the suction port 121D.

The rotational member 125 may include the hinge portion 125A, the first arm portion 125B, and the second arm portion 125C. The hinge portion 125A may be formed in an annular shape. The circular hinge hole 125G into which the rotating shaft 121G is to be inserted may be formed in the hinge portion 125A. The rotational member 125 may be rotatably coupled to the lower case 121C by fitting the rotating shaft 121G into the hinge hole 125.

The second cam 125E is formed in the first arm portion 125B, the second cam 125E which protrudes from the hinge portion 125A to one side and which is interlocked with the first cam 123E formed in the push button 123. The first cam 123E is formed at one side of the lower end of the push button 123. Contact surfaces of the first cam 123E and the second cam 125E may be inclined, so that the first cam 123E is able to push the second camp 125E downward when moving downward upon pushing of the push button 123. The first arm portion 125B protrudes forward from the hinge portion 125A, and the second cam 125E inclined in the forward and backward direction may be formed on one side of the front end of the first arm portion 125B toward the push button 123.

The second arm portion 125C may protrude from the hinge portion 125A in the left and right direction. The second arm portion 125C may protrude from the hinge portion 125A in a direction which is a direction opposite to the push button 123 between the left direction and the right direction. The second arm portion 125C may protrude in a direction orthogonal to a direction in which the first arm portion 125B protrudes.

The detachment pin 126 may be connected to the end of the second arm portion 125C to protrude in a direction opposite to the direction in which the first arm portion 125B protrudes. The detachment pin 126 may be hinged to the end of the second arm portion 125C. The hinge shaft 126D may be formed in one of the end of the second arm portion 125C and the detachment pin 126. The hinge groove or the hinge hole 125D, into which the hinge shaft 126D is inserted to be rotatably coupled thereto, may be formed on the other of the end of the second arm portion 125C and the detachment pin 126.

The guide hole 126H for guiding the linear movement of the detachment pin 126 when the rotational member 125 rotates may be formed in the detachment pin 126. The guide hole 126H may be elongated in the forward and backward direction which is the linear movement direction of the detachment pin 126. The guide protrusion 121H to be inserted into the guide hole 126H may be formed in the lower case 121C. The guide protrusion 121H may have a length in the linear movement direction of the detachment pin 126 than that of the guide hole 126H. When the rotational member 125 rotates, rotation of the detachment pin 126 may be restricted by the guide protrusion 121H. In addition, since the guide protrusion 121H has a length in the forward and backward direction shorter than that of the guide hole 126H, the detachment pin 126 may move linearly in the forward and backward direction when the rotational member 125 rotates.

An elastic member 127 for rotating the rotatable member 125 back to its original position may be coupled to the rotating shaft 121G. A part of the elastic member 127 may be wound in a coil shape, and the rotating shaft 121G may be inserted into the coil-shaped part of the elastic member 127. And a slit 125F may be formed in the rotational member 125. The slit 125F may be elongated from the hinge hole 125G of the hinge portion 125A to a portion of the first arm portion 125B and the second arm portion 125C. The slit 125F may be formed in a long groove shape in the first arm portion 125B such that the upper side of the second arm portion 125C is opened. The elastic member 127 may be coupled to the rotating shaft 121G and the slit 125F. One end of the elastic member 127, except the coil-shaped part, may be fixed to the rotating shaft 121G and the slit 125F of the first arm portion 125B, and the other end of the elastic member 127 may be fixed to the slit 125F of the second arm portion 125C.

When the user pushes down the push button 123 from above the nozzle 120 in order to detach the nozzle 120 from the connector 118, the rotational member 125 rotates about the rotating shaft 121G in one direction. At this time, the elastic member 127 may generate an elastic force for returning the rotational member 125 back to its original position. When the user detaches the nozzle 120 from the connector 118 and then releases the push button 123, the rotational member 125 may rotate about the rotation shaft 121G in the other direction.

A button guide boss 121K may protrude from the lower case 121C. The push button 123 may be mounted on the button guide boss 121K to be linearly movable upward and downward. A groove 121L whose upper side is open may be formed inside the button guide boss 121K. The elastic member 128 may be inserted into the groove 121L of the button guide boss 121K. The elastic member 128 may be a coil spring, and the lower end of the elastic member 128 may be inserted into the groove 121L of the button guide boss 121K. In addition, a groove (not shown) whose lower side is open may be formed inside the push button 123. An upper end of the elastic member 128 may be inserted into the groove formed in the push button 123.

When the user presses the push button 123, the elastic member 128 may be compressed to generate an elastic force for returning the elastic member 128 back to its original position. In this state, when the user releases the push button 123, the push button 123 may be returned back to its original position by the elastic force of the elastic member 128.

A stopper 121M for restricting rotation of the first arm portion 125B may protrude from the lower case 121C at a position where the hook coupling of the first connection flow path 118A and the second connection flow path 121A is released. The stopper 121M restrains the rotation of the rotational member 125 when the hook coupling of the first connection flow path 118A and the second connection flow path 121A is released, so that the user does not consume excessive force.

In addition, a separation preventing protrusion 121N protrudes upward of the first arm portion 125B from the stopper 121M. The first arm portion 125B is rotated between the bottom surface of the lower case 121C and the separation preventing protrusion 121N when the rotational member 125 rotates. The separation preventing protrusion 121N may prevent the first arm portion 125B from shaking upward and downward during rotation of the rotational member 125, and prevents the rotational member 125 from coming out of the rotating shaft 121G.

As described above, in the cleaner 100 according to the present invention, the push button 123 is positioned on the upper side of the nozzle 120, and the detachment unit 124 interlocked with the push button 123 is provided inside of the nozzle 120. Therefore, the user may detach the nozzle 120 by intuitively looking at and pushing the push button positioned on the upper side of the nozzle 120.

Particularly, the cleaner 100 according to an embodiment of the present invention provides the automatic mode in which the cleaner travels automatically to perform cleaning, just like a robot cleaner, and the manual mode in which the cleaner travels manually to perform cleaning as a user drags or pushes the cleaner. Therefore, when the user desires to clean in the manual mode, since the nozzle 120 used in the automatic mode must be quickly detached from the main body 110, and then the manual nozzle should be manually mounted on the main body 110, the nozzle 120 used in the automatic mode may be easily detached and replaced with the manual nozzle, and then perform cleaning in the manual mode.

In addition, as the detachment unit 124 is provided inside of the nozzle 120, sealing of the flow path, which is a major factor that affects cleaning performance, may be optimized.

In addition, as the connector 118 not just connects the nozzle 120 and the main body 110, and but also supports the dust box 140, it is possible to provide a cleaner having a simple structure which is achieved through integration of parts.

Those skilled in the art to which the present invention pertains will appreciate that the present invention may be carried out in specific ways other than those set forth herein without departing from the spirit and essential characteristics of the present invention. The above embodiments are therefore to be construed in all aspects as illustrative and not restrictive. The scope of the invention should be determined by the appended claims and their legal equivalents, not by the above description, and all changes coming within the meaning and equivalency range of the appended claims are intended to be embraced therein.

What is claimed is:

1. A cleaner, comprising:

a main body having a first connection flow path which is formed in an outside of the main body to guide air from the outside to an inside of the main body; and a nozzle having a suction port through which air is introduced:

wherein the nozzle comprises:

a case in which the suction port and a second connection flow path are formed, wherein the second connection flow path guides the air introduced through the suction port to the outside and is hooked to the first connection flow path;

a push button being able to linearly move through one surface of the case in a predetermined pressing direction; and a coupling mounted in the case to be rotated about a rotating shaft positioned in a direction parallel to the pressing direction, and interlocked with the push button to release hook coupling of the first connection flow path and the second connection flow path when rotating, wherein the coupling comprises:

a rotational member interlocked with the push button to be rotated about the rotating shaft, and positioned in the case; and a detachment pin hinged to the rotational member to linearly move in response to rotation of the rotational member and release the hook coupling by protruding out of the case in response to linear movement thereof, wherein the rotating shaft is formed in the case, wherein a hinge hole to be hinged to the rotating shaft is formed in the rotational member, wherein a slit extending from the hinge hole is formed in the rotational member, and wherein the nozzle further comprises an elastic member to be coupled to the rotating shaft and the slit to return the rotational member back to an original position thereof.

2. The cleaner of claim 1, wherein the rotational member comprises:

a hinge portion hinged to the case;

a first arm portion protruding from the hinge portion in a first direction and contacting the push button; and a second arm portion protruding in a second direction different from the first direction, and wherein the detachment pin is connected to an end of the second arm to protrude in a direction crossing the second direction.

3. The cleaner of claim 2, wherein the second arm portion protrudes in a direction crossing to the first direction, and wherein the detachment pin is connected to the end of the second arm portion to protrude in a direction opposite to the first direction.

4. The cleaner of claim 2, wherein a guide hole for guiding linear movement of the detachment pin in response to rotation of the rotational member is formed in the detachment pin, and wherein a guide protrusion to be inserted into the guide hole is formed in the case.

5. The cleaner of claim 1, wherein the rotational member comprises:

a hinge portion hinged to the case;

a first arm portion protruding from the hinge portion in a first direction and contacting the push button; and a second arm portion protruding from the hinge portion in a second direction different from the first direction, and wherein the push button presses the first arm portion, when moving in the pressing direction, to rotate the rotational member.

6. The cleaner of claim 5, wherein a first cam is formed in the push button, and wherein a second cam slidingly interlocked with the first cam is formed in the first arm portion.

7. The cleaner of claim 1, wherein the second connection flow path is inserted into the first connection flow path, and wherein the detachment pin is inserted into the first connection flow path from an outside of the second connection flow path to push a hook portion formed in the first connection flow path, thereby releasing the hook coupling of the first connection flow path and the second connection flow.

8. The cleaner of claim 1, wherein a button guide boss protrudes from the case so that the push button is allowed to linearly move upward and downward.

9. The cleaner of claim 8, wherein the nozzle further comprises an elastic member to be inserted into the button guide boss to return the push button to an original position thereof.

10. A cleaner, comprising:

a main body having a first connection flow path which is formed in an outside of the main body to guide air from the outside to an inside of the main body; and a nozzle having a suction port through which air is introduced, wherein the nozzle comprises:

a case in which the suction port and a second connection flow path are formed, wherein the second connection flow path guides the air introduced through the suction port to the outside and is hooked to the first connection flow path;

a push button being able to linearly move through one surface of the case in a predetermined pressing direction; and a coupling mounted in the case to be rotated about a rotating shall positioned in a direction parallel to the pressing direction, and interlocked with the push button to release hook coupling of the first connection flow path and the second connection flow path when rotating, wherein the coupling comprises:

a rotational member interlocked with the push button to be rotated about the rotating shaft, and positioned in the case; and a detachment pin hinged to the rotational member to linearly move in response to rotation of the rotational member and release the hook coupling by protruding out of the case in response to linear movement thereof, wherein the rotational member comprises:

a hinge portion hinged to the case;

a first arm portion protruding from the hinge portion in a first direction and contacting the push button; and a second arm portion protruding in a second direction different from the first direction in which the first arm portion protrudes from the hinge portion, wherein the detachment pin is connected to an end of the second arm to protrude in a direction crossing the second direction in which the second aim portion protrudes, wherein a stopper for restraining rotation of the first arm portion protrudes from the case at a position where the hook coupling of the first connection flow path and the second connection flow path is released, and wherein a separation preventing protrusion protrudes upward of the first arm portion from the stopper.

11. The cleaner of claim 1, wherein the main body protrudes outward further than the first connection flow path and the second connection flow path, and wherein the nozzle protrudes outward further than the main body.

12. The cleaner of claim 1, further comprising:

a dust box detachably coupled to the main body and storing a foreign substance; and a connector connecting the main body and the nozzle, and having the dust box seated therein, wherein the first connection flow path is formed in the connector.

13. The cleaner of claim 1, wherein the case comprises:

an upper case in which a through hole, through which the push button passes in a vertical direction, and the second connection flow path are formed; and a lower case which is coupled to the upper case, and in which the suction port communicating with an inner space of the upper case, the push button able to linearly move upward and downward, and the coupling abler to rotate are formed.

* * * * *